US006767180B2

(12) United States Patent
Kobayashi et al.

(10) Patent No.: US 6,767,180 B2
(45) Date of Patent: Jul. 27, 2004

(54) IMPELLER TYPE FUEL PUMP

(75) Inventors: Atsushige Kobayashi, Nagoya (JP); Kiyotoshi Ol, Anjo (JP)

(73) Assignee: Denso Corporation (JP)

( * ) Notice: Subject to any disclaimer, the term of this patent is extended or adjusted under 35 U.S.C. 154(b) by 0 days.

(21) Appl. No.: 10/261,633

(22) Filed: Oct. 2, 2002

(65) Prior Publication Data

US 2003/0068221 A1 Apr. 10, 2003

(30) Foreign Application Priority Data

Oct. 10, 2001 (JP) ..... 2001-312453

(51) Int. Cl.[7] ..... F01D 1/12
(52) U.S. Cl. ..... 415/55.1
(58) Field of Search ..... 415/55.1, 55.2, 415/55.3, 55.4, 55.5, 55.6, 55.7

(56) References Cited

U.S. PATENT DOCUMENTS 5,011,369 A 4/1991 Mine et al. ..... 415/55.1
5,336,045 A * 8/1994 Koyama et al. ..... 415/55.1
5,498,124 A * 3/1996 Ito et al. ..... 415/55.1
5,765,992 A 6/1998 Muramatsu et al. ..... 415/55.1
5,921,746 A * 7/1999 Yu et al. ..... 415/55.1
6,468,027 B2 * 10/2002 Narisako et al. ..... 415/55.1
6,547,515 B2 * 4/2003 Ross ..... 415/55.1

FOREIGN PATENT DOCUMENTS

JP 03160192 A * 7/1991 ..... 415/55.1

* cited by examiner

*Primary Examiner*—Thomas Denion
*Assistant Examiner*—Thai Ba Trieu
(74) *Attorney, Agent, or Firm*—Nixon & Vanderhye PC

(57) ABSTRACT

A fuel pump includes an impeller and a passage member having a pump passage around the impeller, a fuel suction port and a fuel discharge port. The pump passage includes an arc-shaped fuel passage connected to the suction port and a terminal fuel passage connected to the discharge port. The discharge port is located outside the pump passage in the radial direction, and the terminal fuel passage is formed so that a portion of the terminal fuel passage is located radially more outside as the portion of the terminal fuel passage moves in the rotation direction of the impeller. The sectional area of the terminal fuel passage except spaces occupied by the impeller is approximately constant to prevent flow energy loss.

6 Claims, 6 Drawing Sheets

IMPELLER TYPE FUEL PUMP

CROSS REFERENCE TO RELATED APPLICATION

The present application is based on and claims priority from Japanese Patent Application 2001-312453, filed Oct. 10, 2001, the contents of which are incorporated herein by reference.

BACKGROUND OF THE INVENTION

1. Field of the Invention

The present invention relates to an impeller type fuel pump for pumping fuel up from a fuel tank.

2. Description of the Related Art

A fuel pump that has an impeller is well known, as disclosed in U.S. Pat. Nos. 5,765,992 and 5,011,369.

U.S. Pat. No. 5,765,992 discloses a pump having an impeller in which fuel flows along an arc-shaped passage and is discharged from a fuel discharge port that is located radially outward from the arc-shaped passage. Because an end of the arc-shaped passage is formed near the discharge port, the fuel collides with a wall of the housing when the fuel flows toward the discharge port. This collision generates a considerable flow resistance and a noise.

U.S. Pat. No. 5,011,369 discloses another pump having an impeller. This fuel pump has an arc-shaped fuel passage whose cross section increases as it nears the end of the arc-shaped fuel passage. Therefore, flow speed of the fuel decreases and flow energy decreases as the fuel nears the discharge port. This decreases the pump efficiency.

SUMMARY OF THE INVENTION

Therefore, the present invention has been made in view of the above problems.

According to a feature of the invention, a pump passage includes an arc-shaped fuel passage connected to a suction port and a terminal fuel passage connected to a discharge port. The discharge port is located outside the pump passage in the radial direction. The terminal fuel passage extends so that a portion thereof is located radially more outside as the portion moves in the rotation direction. The sectional area of the terminal fuel passage except spaces occupied by the impeller is approximately constant between the arc-shaped passage and the fuel discharge port. Therefore, the fuel flowing into the base of the blade ditches immediately flows out from the outer edge of the blade ditches so that formation of circulating flow can be suppressed. Therefore, the fuel flow is converged into a flow flowing along the circumference of the impeller. Because fuel flows from the arc-shaped fuel passage to the terminal fuel passage smoothly, flow energy loss can be suppressed so that pump efficiency can be improved.

According to another feature of the invention, the terminal fuel passage has a radially outside surface inclining so that a space between the outside surface and the outer circumference of the impeller increases as the outside surface nears the discharge port.

According to another feature of the invention, an angle formed between the outside surface and a tangential line of the outer circumference of the impeller is approximately the same as an angle between fuel flow discharged from the blade ditches and the tangential line. Therefore, the fuel flowing out of the blade ditches of the impeller does not change the flow direction thereof and flows in the terminal fuel passage along the outer passage surface without pealing off, so that flow energy loss can be minimized.

BRIEF DESCRIPTION OF THE DRAWINGS

Other objects, features and characteristics of the present invention as well as the functions of related parts of the present invention will become clear from a study of the following detailed description, the appended claims and the drawings. In the drawings:

FIG. 1B is a cross-sectional view of FIG. 1A cut along line IB—IB, FIG. 1C is a cross-sectional view of FIG. 1A cut along line IC—IC and FIG. 1D is a cross-sectional view of FIG. 1A cut along line ID—ID;

FIG. 6B is a cross-sectional view of FIG. 6A cut along line VIB—VIB, FIG. 6C is a cross-sectional view of FIG. 1A cut along line VIC—VIC and FIG. 6D is a cross-sectional view of FIG. 6A cut along line VID—VID.

DETAILED DESCRIPTION OF THE PREFERRED EMBODIMENTS

Fuel pumps according to preferred embodiment of the invention will be described with reference to the appended drawings.

A fuel pump 10 according to the first embodiment of the invention is described with reference to FIGS. 1A–1D, FIGS. 2–4, and FIGS. 5A and 5B.

The fuel pump 10 according to the first embodiment of the invention is usually located in a fuel tank of a vehicle as a component of an electrically controlled fuel injection system for pumping up and supplying fuel to an engine.

Figure 2:
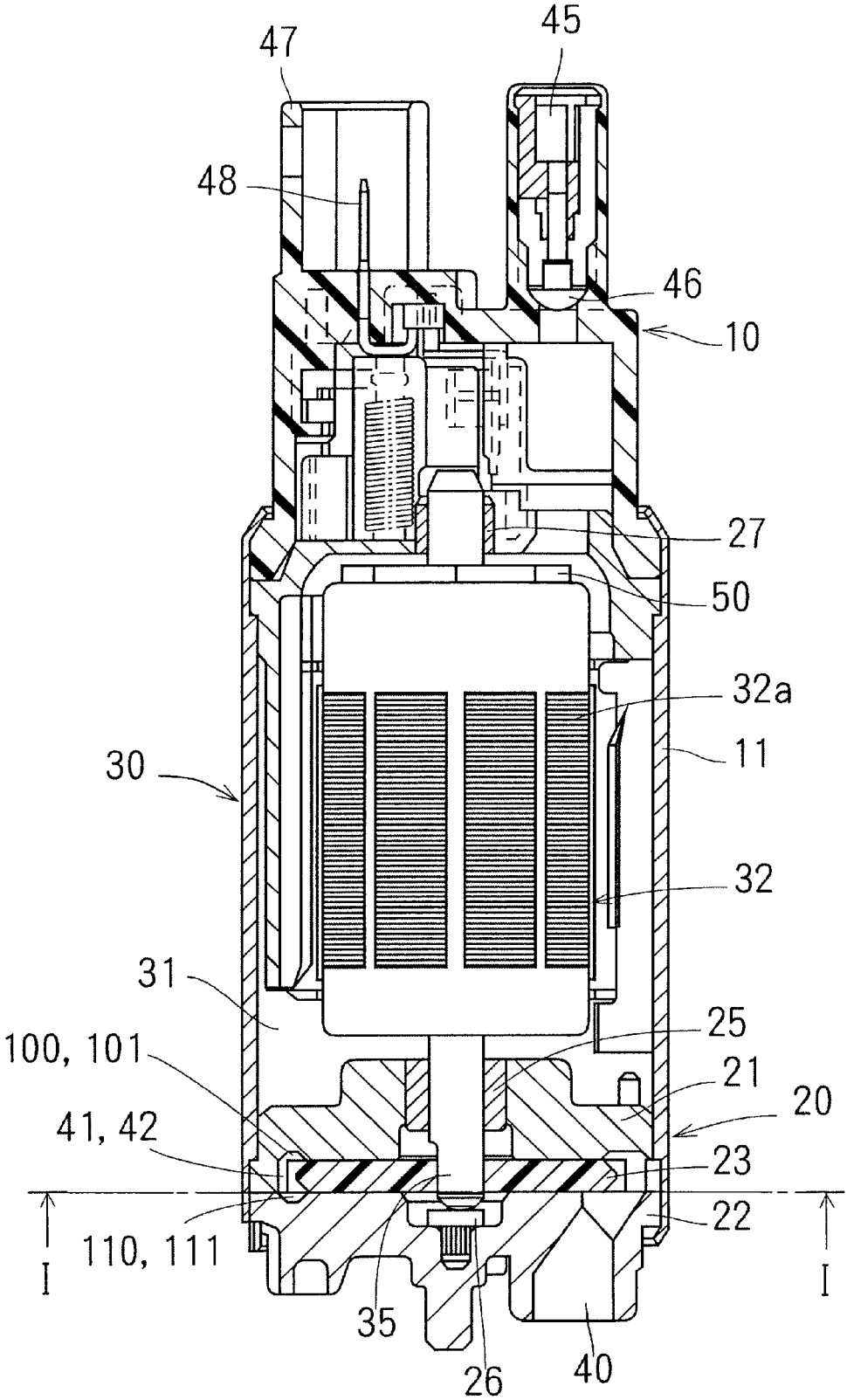
FIG. 2 is a cross-sectional side view of the fuel pump according to the first embodiment.

As shown in FIG. 2, the fuel pump 10 includes a pump section 20 and a motor section 30. The motor section 30 is a DC motor that has a cylindrical housing 11, a plurality of permanent magnets, an armature that is coaxially disposed in the housing 11 and a plurality of brushes. The pump section 20 includes a main casing 21, a casing cover 22 and an impeller 23. The main casing 21 and the casing cover 22 form a fuel passage member, which accommodate and rotatably support the impeller 23. The impeller 23 has a plurality of blades 23*a* and blade ditches 23*b* distributed on the whole outer periphery thereof. The main casing 21 and the casing cover 22 are made of aluminum die-casting. The main casing 21 has a bearing 25 at the center thereof and is force-fitted deep into an end of the housing 11 at the outer periphery thereof. The casing cover 22 is also inserted into the same end of the housing 11 so as to cover the main casing 22 and is clamped at the outer periphery thereof by the edge portion of the housing 11. A thrust bearing 26 is force-fitted to a center hole of the casing cover 22 to support an end of the rotary shaft 35 in the axial direction. The rotary shaft 35 is also supported by a bearing 27 at the other end thereof.

Figure 1A:
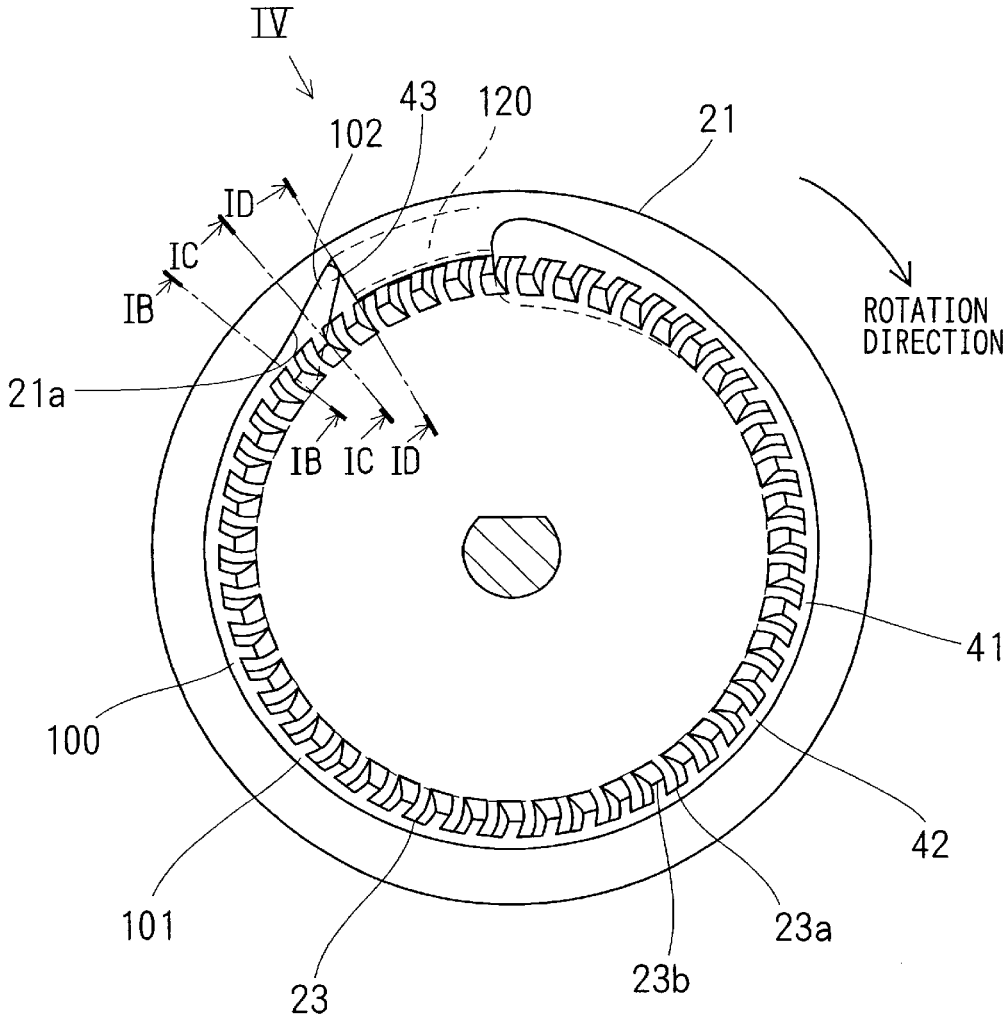
FIGS. 1A–1D are respective cross-sectional views of a fuel pump according to the first embodiment of the invention.
Figure 3:
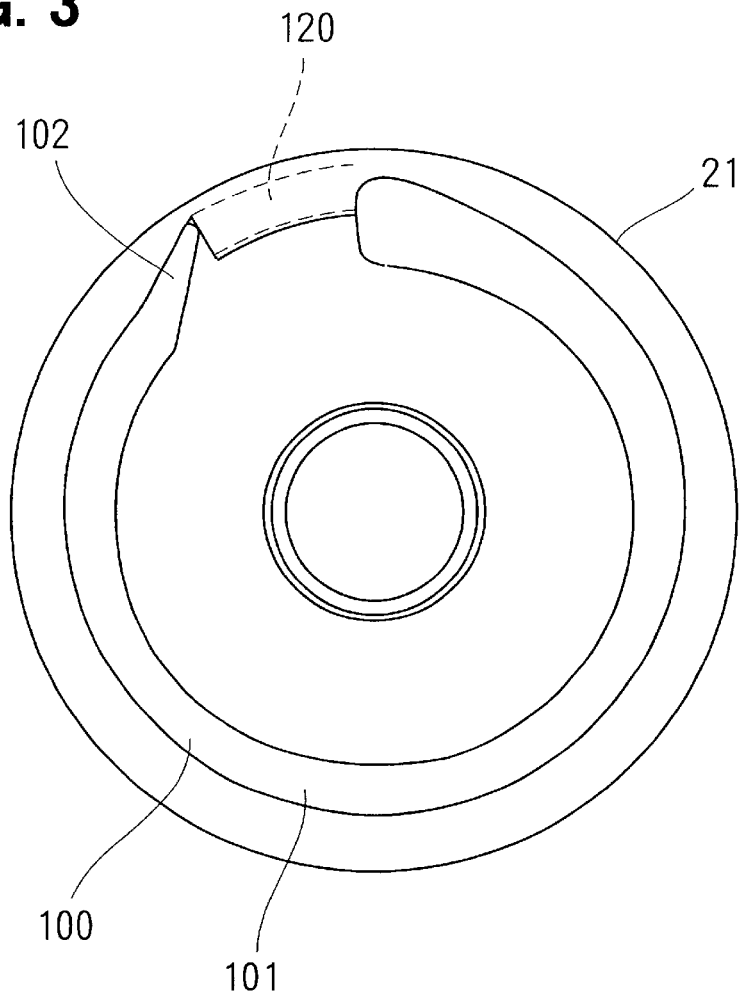
FIG. 3 is a plan view of a portion of a casing of the fuel pump according to the first embodiment.
Figure 4:
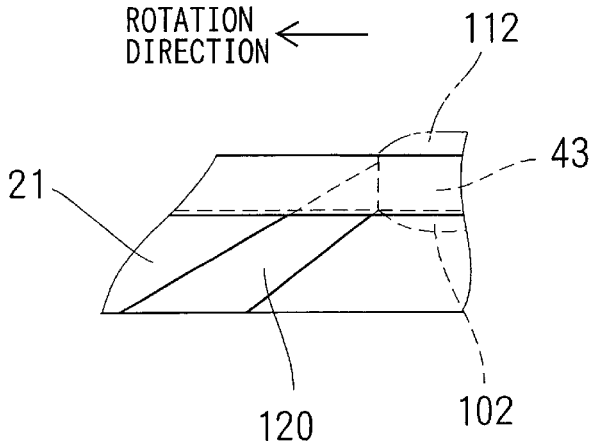
FIG. 4 is a fragmentary view of a portion shown in FIG. 1A viewed from position IV.
Figure 5A:
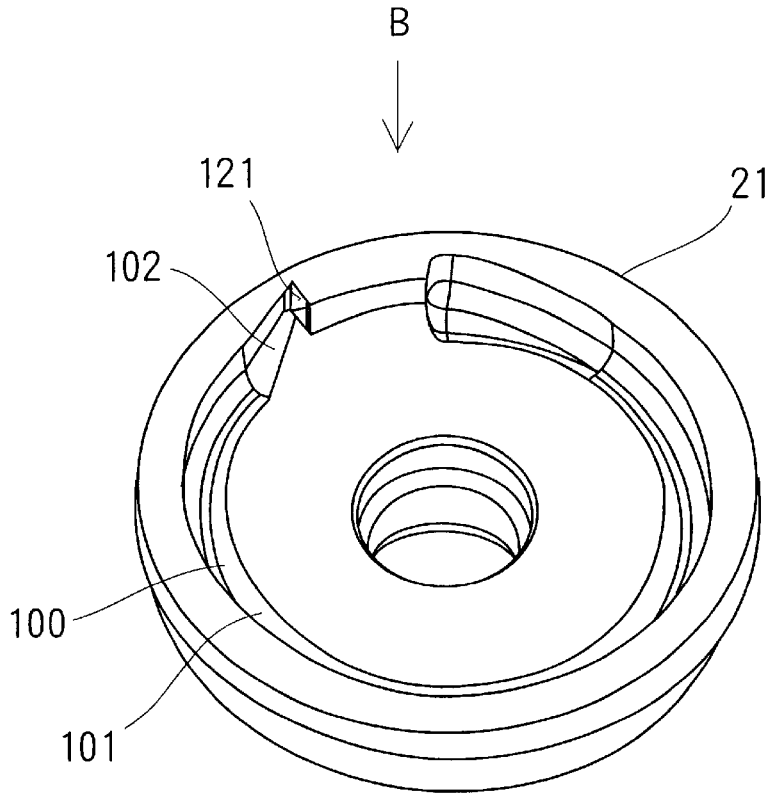
FIGS. 5A and 5B are perspective views of the casing of the fuel pump according to the first embodiment.
Figure 5B:
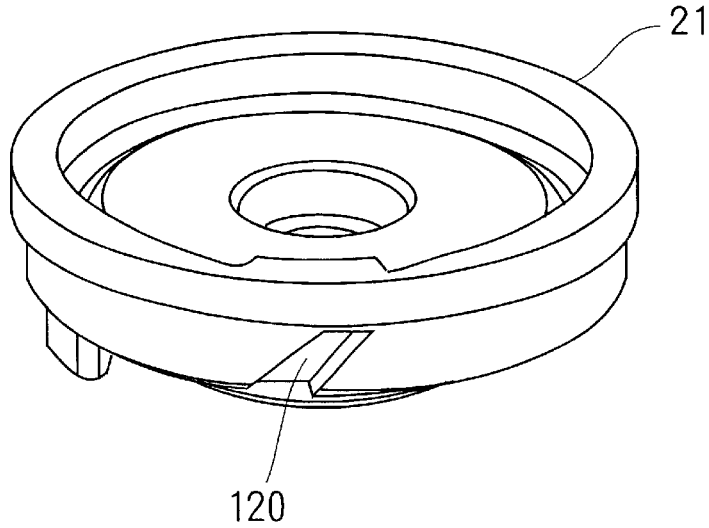

The casing cover 22 has a fuel suction port 40 through which fuel in a fuel tank (not shown) is sucked and supplied to a pump passage 41. The pump passage 41 includes a groove 100 formed in the main casing 21 and a groove 110 formed in the casing cover 22, which form a C-shaped groove. The groove 100 includes an arc-shaped groove 101 and a terminal groove 102, as shown in FIG. 3. The groove 110 also includes an arc-shaped groove 111 at the portion thereof opposite the passage 101, as shown in FIG. 1A, and a terminal groove 112 at the portion thereof opposite the terminal groove 102, as shown in FIG. 4. Therefore, the arc-shaped grooves 101 and 111 form an arc-shaped fuel passage 42, and the terminal grooves 102 and 112 form a terminal fuel passage 43, as shown in FIG. 1A. Fuel pressured in the arc-shaped fuel passage 42 flows through the terminal fuel passage 43 and the fuel discharge port 121 toward a discharge passage 120 formed in the main casing 21, as shown in FIG. 4. Thus, the fuel sucked into the pump passage 41 is pressured by the impeller 23 and discharged from the discharge port 120 to a fuel chamber 31 in the motor section 30.

As shown in FIG. 1A, the terminal fuel passage 43 extends from an end of the arc-shaped fuel passage 41 so that a portion of the terminal fuel passage 43 is located radially more outside as the portion moves in the rotation direction of the impeller 23. The terminal fuel passage 43 is connected to a discharge port 121 of the discharge passage 120. The discharge port 121 is located outside the blades 23*a* of the impeller 23 and the arc-shaped fuel passage 42 in the radial direction, as shown in FIGS. 1A and 1D.

Figure 1B:
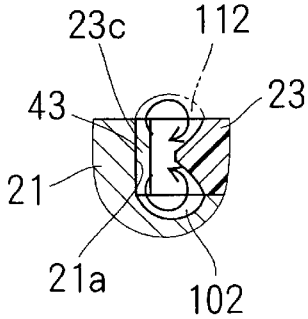
Figure 1C:
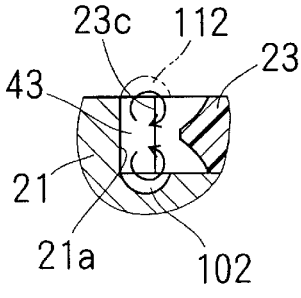
Figure 1D:
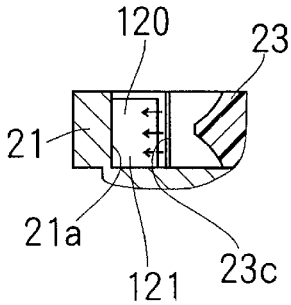

The terminal groove 102 formed in the main casing 21 and the terminal groove 112 formed in the casing cover 22 have bottoms that shallow as the grooves nears the fuel discharge port 121, as shown in FIGS. 1B–1D. In other words, the terminal fuel passage 43 has narrower width at a portion thereof as the portion nears the fuel discharge port 121 along the rotation direction of the impeller 23. On the other hand, a distance between a radially outer passage surface 21*a* of the terminal fuel passage 43, which is formed in the main casing 21, and the outer edges 23*c* of the impeller 23 at a position increases as the position nears the discharge port 121.

Therefore, the sectional area of the terminal fuel passage 43 except spaces occupied by the impeller 23 is approximately constant between the arc-shaped fuel passage 42 and the fuel discharge port 121. An angle formed between the outer passage surface 21*a* of the terminal fuel passage 43 and the tangential line of the circumference of the outer edges of the impeller 23 is approximately the same as an angle formed between a direction of fuel flowing out of the impeller blades ditches 23*b* and the above tangential line.

An armature 32 is disposed in the motor section 30 and an armature coil is wound around an armature core 32*a*. A disk-like commutator 50 is mounted on the armature 32 so that electric power is supplied from a power source (not shown) to a terminal 48 of a connector 47 and, via brushes and the commutator 50, to the armature 32. When the armature 32 rotates, the rotary shaft 35 rotates the impeller 23 to suck fuel from the fuel suction port 40 into the pump passage 41.

In the pump passage 41, the fuel flows out of the blade ditches 23*b* of the impeller 23 toward the outer passage surface 21*a*. The fuel returns to the blade ditches 23*b* from the outer passage surface 21*a* of the main casing 21 and flows out of the blade ditches toward the outer passage surface again. After the fuel repeats the above flowing out and returning, the fuel is pressured and forms a circulating flow. The fuel pressured in the pump passage 41 is discharged from discharge passage 120 into the fuel chamber 31. The fuel in the fuel chamber 31 passes around the armature 32 and is discharged to the outside from the discharge port 45. The discharge port 45 accommodates a check valve 46 for preventing back flow.

The fuel flow between the pump passage 41 and the discharge passage 120 is described below.

Fuel is sucked from the fuel suction port 40 and introduced into the pump passage 41 to be pressured by the rotating impeller 23. Then, the fuel flows from the terminal fuel passage 43 to the discharge passage 120. The terminal fuel passage 43 extends toward radially outward along the rotation direction of the impeller, so that the blades 23*a* of the impeller 23 leaves from the terminal fuel passage 43 and the outer passage surface 21*a* of the main casing 21. Accordingly, at the terminal fuel passage, the fuel flowing from the base portions of the blade ditches 23*b* immediately flows out of the peripheral edges of the blade ditches 23*b*, so that formation of the circulating flow is gradually suppressed. This prevents noises caused by the circulating flow that collides against the main casing 21 and the casing cover 22. The fuel flow is converged into a flow flowing along the circumference of the impeller 23 toward the discharge passage 121.

Because the cross-sectional area of the terminal fuel passage 43 toward the discharge port 121 except the impeller 23 is approximately constant, the flow speed of the fuel between the arc-shaped fuel passage 42 and the discharge port 121 is approximately constant.

Because the angle forming between the outer passage surface 21*a* and the tangential line of the circumference 23*c* of the impeller 23 at the starting end of the terminal fuel passage 43 is approximately the same as the angle forming between the flow of the fuel flowing out of the blade ditches 23*b* and the above tangential line, the fuel flowing out of the blade ditches 23*b* of the impeller 23 does not change the flow direction thereof and flows in the terminal fuel passage along the outer passage surface 21*a* without pealing off.

Because the discharge passage 120 connects the terminal fuel passage 43 with a small turning angle, flow resistance of the connection is negligibly small. Therefore, the pump efficiency is improved.

A fuel pump according to the second embodiment of the invention is described with reference to FIGS. 6A–6D and FIG. 8. Incidentally, the same reference numeral indicates the same or substantially the same component or portion of the fuel pump according to the first embodiment.

A pump passage 201 includes a groove 210 formed in a main casing 200 and a groove formed in a casing cover, which form a C-shaped groove as in the fuel pump according to the first embodiment. The groove 210 includes an arc-shaped groove 211 and a terminal groove 212. The groove formed in the casing cover also includes an arc-shaped groove at the portion thereof opposite the groove 211 and a terminal groove at the portion thereof opposite the terminal groove 212. Therefore, the arc-shaped groove 211 and the corresponding arc-shaped groove formed in the casing cover form an arc-shaped fuel passage 202, and the terminal grooves 212 and the corresponding terminal groove formed in the casing cover form a terminal fuel passage 203. Fuel pressured in the arc-shaped fuel passage 202 flows through the terminal fuel passage 203 and the fuel discharge port 121 toward the discharge passage 120. The terminal fuel passage 203 extend from an end of the arc-shaped fuel passage 202 so that a portion of the terminal fuel passage 203 is located radially more outside as the portion moves in the rotation direction of the impeller 23.

Figure 6A:
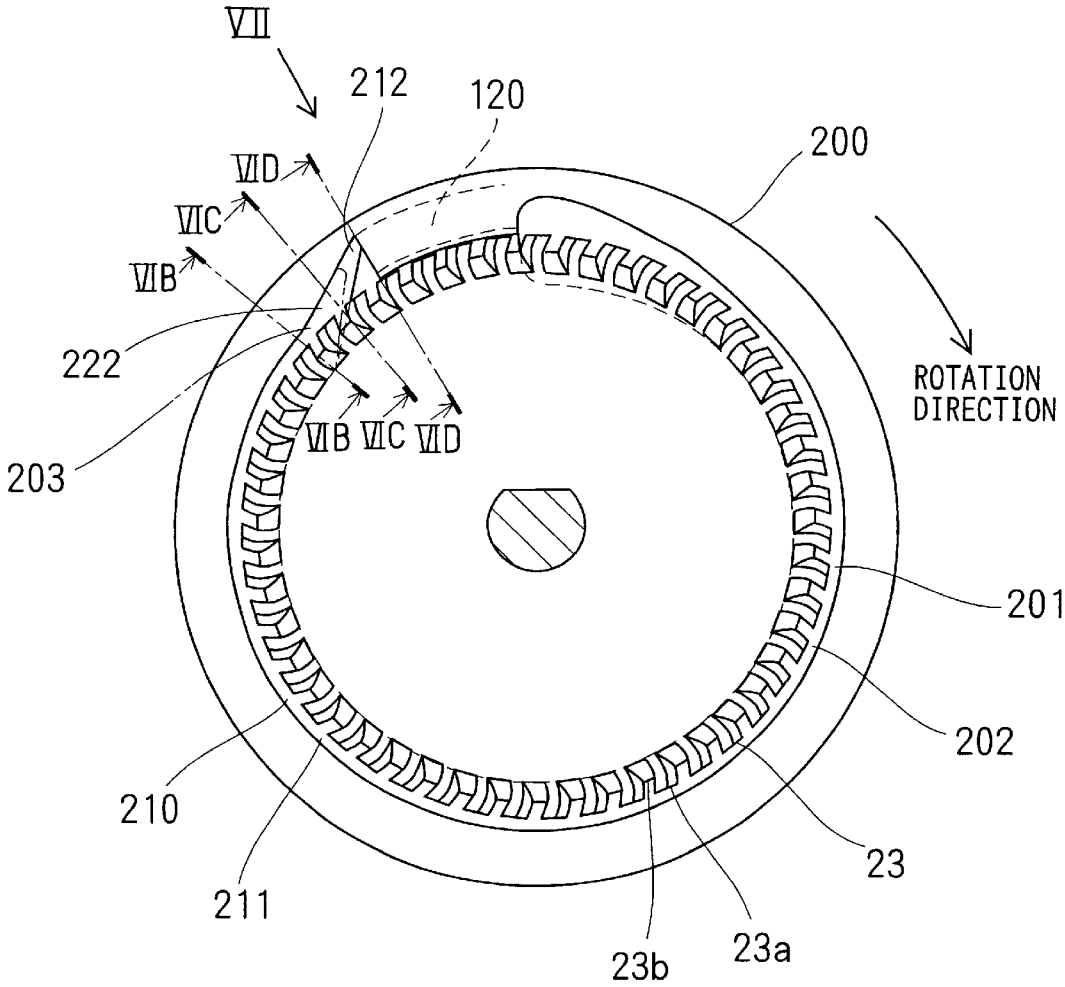
FIGS. 6A–6D are respective cross-sectional views of a fuel pump according to the second embodiment of the invention.
Figure 6B:
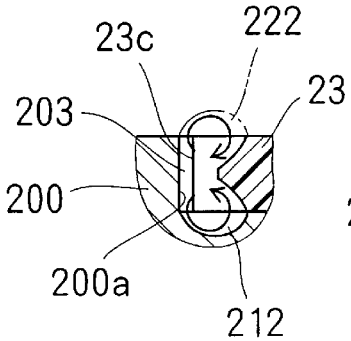
Figure 6C:
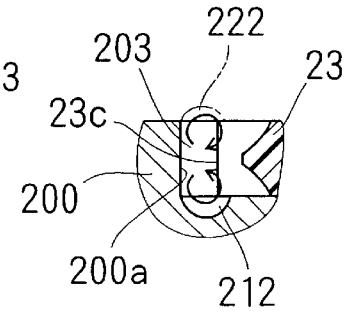
Figure 6D:
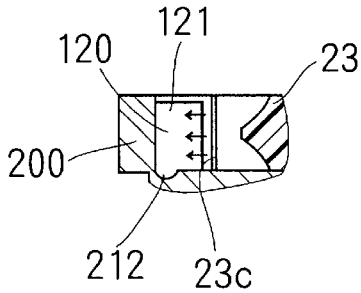

The terminal groove 212 formed in the main casing 200 and the terminal groove 222 formed in the casing cover 22 have bottoms that shallow as the grooves nears the fuel discharge port 121, as shown in FIGS. 6B–6D. In other words, the terminal fuel passage 203 has narrower width at a portion thereof as the portion nears the fuel discharge port 121 toward the rotation direction of the impeller 23. On the other hand, a distance between a radially outer passage surface 200*a* of the main casing 200 and the outer edges 23*c* of the impeller 23 at a position increases as the position nears the discharge port 121. Therefore, the sectional area of the terminal fuel passage 203 except spaces occupied by the impeller 23 is approximately constant between the arc-shaped fuel passage 202 and the fuel discharge port 121. An angle formed between the terminal groove 212 of the terminal fuel passage 203 and the discharge passage 120 is closer to 180 degree than the angle formed between the terminal groove 102 and the discharge passage of the fuel pump according to the first embodiment. Accordingly, flow resistance of the connection is negligibly small, and the pump efficiency is improved.

Figure 7:
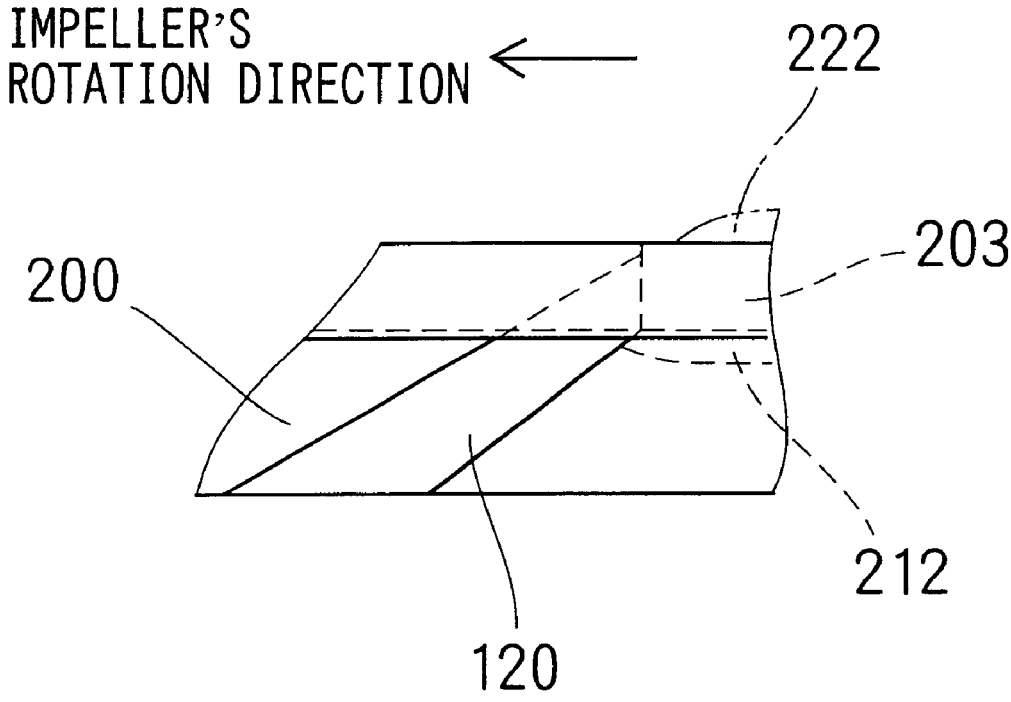
FIG. 7 is a fragmentary view of a portion shown in FIG. 6A viewed from position VII.

As shown in FIG. 7, the terminal groove 222 shallows in front of the terminal groove 212 in the rotation direction of the impeller 23 to narrow the terminal fuel passage. Because the position where the terminal groove 212 narrows and the position where the terminal groove 222 narrows are different, the fuel flow energy does not concentrate on one spot so that noise can be suppressed effectively.

In the foregoing description of the present invention, the invention has been disclosed with reference to specific embodiments thereof. It will, however, be evident that various modifications and changes may be made to the specific embodiments of the present invention without departing from the scope of the invention as set forth in the appended claims. Accordingly, the description of the present invention is to be regarded in an illustrative, rather than a restrictive, sense.

What is claimed is:

1. A fuel pump including a rotatable impeller having a plurality of blades and blade ditches on the periphery thereof and a passage member having a pump passage around said impeller, a fuel suction port and a fuel discharge port, wherein:

said pump passage includes an arc-shaped fuel passage connected to said suction port and a terminal fuel passage upstream of and connected to said discharge port;

said discharge port is located outside said pump passage in the radial direction of said passage member;

said terminal fuel passage extending so that a radially outer passage surface thereof is inclined to be gradually located radially farther outside said impeller in the rotation direction of said impeller; and the sectional area of said terminal fuel passage except spaces occupied by said impeller is approximately constant between said arc-shaped fuel passage and said fuel discharge port.

2. The fuel pump as claimed in claim 1, wherein an inclining angle between said radially outer passage surface and a tangential line of the outer circumference of said impeller is approximately the same as an angle between fuel flow discharged from said blade ditches and said tangential line of said outer circumference of said impeller.

3. A fuel pump including an impeller having a plurality of blades and blade ditches on the periphery thereof and a passage member having a pump passage around said impeller, a fuel suction port disposed at an upstream end of said pump passage in a rotation direction of the impeller and a fuel discharge port disposed at a downstream end of said pump passage in the rotation direction, wherein:

said pump passage includes an arc-shaped fuel passage having one end connected to said suction port and a terminal fuel passage connected between the other end of said arc-shaped fuel passage and said discharge port;

said discharge port is located outside said pump passage in the radial direction of said passage member;

said terminal fuel passage extends so that a portion thereof is located radially more outside as said portion approaches said fuel discharge port in the rotation direction of said impeller; and the sectional area of said terminal fuel passage except spaces occupied by said impeller is approximately constant between said arc-shaped passage and said fuel discharge port.

4. The fuel pump as claimed in claim 3, wherein said terminal fuel passage has a radially outside surface inclining so that a space between said radially outside surface and the outer circumference of said impeller increases as said radially outside surface nears said discharge port.

5. A fuel pump including an impeller having a plurality of blades and blade ditches on the periphery thereof and a passage member having a pump passage around said impeller, a fuel suction port and a fuel discharge port, wherein:

said pump passage includes an arc-shaped fuel passage connected to said suction port and a terminal fuel passage connected to said discharge port;

said discharge port is located outside said pump passage in the radial direction of said passage member;

said terminal fuel passage extends so that a portion thereof is located radially more outside as said portion moves in the rotation direction of said impeller; and the sectional area of said terminal fuel passage except spaces occupied by said impeller is approximately constant between said arc-shaped passage and said fuel discharge port, wherein said terminal fuel passage has a radially outside surface inclining so that a space between said radially outside surface and the outer circumference of said impeller increases as said radially outside surface nears said discharge port, wherein an inclining angle between said outside surface and a tangential line of said outer periphery of said impeller is approximately the same as an angle between fuel flow discharged from said blade ditches and said tangential line of said outer circumference of said impeller.

6. The fuel pump as claimed in claim 4, wherein an inclining angle between said radially outside surface and a tangential line of said outer periphery of said impeller is approximately the same as an angle between fuel flow discharged from said blade ditches and said tangential line of said outer circumference of said impeller.

* * * * *

UNITED STATES PATENT AND TRADEMARK OFFICE

CERTIFICATE OF CORRECTION

PATENT NO. : 6,767,180 B2
DATED : July 27, 2004
INVENTOR(S) : Kobayshi et al

It is certified that error appears in the above-identified patent and that said Letters Patent is hereby corrected as shown below:

Title page,
Item [75], Inventors, "Atsushige Kobayashi, Nagoya (JP);
Kiyotoshi Ol, Anjo (JP)"

should be

-- Atsushige Kobayashi, Nagoya (JP);
Kiyotoshi Oi, Anjo (JP) --

Signed and Sealed this

Twenty-eighth Day of September, 2004

JON W. DUDAS
*Director of the United States Patent and Trademark Office*